US006521839B1

(12) United States Patent
Komatsu et al.

(10) Patent No.: US 6,521,839 B1
(45) Date of Patent: Feb. 18, 2003

(54) INSULATION-OPERATING ROD

(75) Inventors: Ken Komatsu, Tokyo (JP); Nobuya Nakajima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,250

(22) Filed: Mar. 27, 2002

(30) Foreign Application Priority Data

Sep. 17, 2001 (JP) ..... 2001-281967

(51) Int. Cl.[7] ..... H01B 17/26
(52) U.S. Cl. ..... 174/142; 218/154
(58) Field of Search ..... 174/142, 152 R, 174/152 GM, 166 R, 178, 180, 182, 185, 186, 193, 194, 195, 201, 205, 210; 218/123, 154

(56) References Cited

U.S. PATENT DOCUMENTS 3,592,959 A * 7/1971 Dougherty ..... 174/158 R
3,962,667 A * 6/1976 Link ..... 174/142
4,426,547 A * 1/1984 Ogino ..... 174/142
4,972,291 A * 11/1990 Cunningham ..... 174/166 R
6,342,685 B1 * 1/2002 Perret ..... 218/154

FOREIGN PATENT DOCUMENTS

| | | |
|---|---|---|
| JP | 64-81135 | 3/1989 |
| JP | 1-154419 | 6/1989 |
| JP | 6-318415 | 11/1994 |

* cited by examiner

*Primary Examiner*—Anthony Dinkins
*Assistant Examiner*—Adolfo Nino

(57) ABSTRACT

A cylindrical insulating rod 2 and a connecting rod 3 are connected to each other by a metallic shield ring 5 and a connecting pin 4. The metallic shield ring 5 has second shield portions 51 and 52 for electrical field relaxation on the external surface, and in which an inserted end receiving portion 21 of the insulating rod 2 is inserted. The connecting pin 4 is inserted through the metallic shield ring 5, the inserted end receiving portion 21 of the insulating rod 2 and an end portion of the connecting rod 32. The insulation-operating rod is capable of being small-sized, and has stable mechanical and electrical characteristics.

5 Claims, 3 Drawing Sheets

INSULATION-OPERATING ROD

BACKGROUND OF THE INVENTION

1. Field of the Invention

The present invention relates to an insulation-operating rod for use in switchgears in an electric power system such as power generation and/or transformation, and more specifically to an insulation-operating rod suited for porcelain-clad type circuit breakers.

2. Background of the Invention

FIG. 5 is a sectional view of a conventional insulation-operating rod disclosed in the Japanese Patent Publication (unexamined) No. 318415/1994. In FIG. 5, reference numeral 2 is a cylindrical insulating rod which is, for example, formed into a cylindrical shape by impregnating glass fibers with a thermosetting resin. This insulating rod is provided with internal thread 24 on the internal surface and external thread 25 on the external surface of two ends thereof. Numerals 7 and 8 are connecting rods. The connecting rod 7 is provided with a hemispherical shield portion 74 on one end thereof, and an external thread 71 threadably engaging with the internal thread 24 of the insulating rod 2. The connecting rod 7 is also provided with a flange 73 coming in contact with an end of the insulating rod 2 between the main body of the connecting rod 72 and the external thread 71.

The connecting rod 8 is provided with an external thread 81 threadably engaging with the insulating rod 2, a flange 83 coming in contact with another end of the insulating rod 2, an internal thread 82 along the axis of the connecting rod 8. Main body of a connecting rod 84 threadably engages with the internal thread 82. Numeral 9 is a connector provided with a through hole 93 at a bottom plate 92 on an end of a cylindrical part 91, and an internal thread 94 is formed on the internal surface of a cylindrical part 91. In addition, each connector 9 presses the flanges 73 and 83 of the connecting rods 7 and 8 as a result of threadably engaging the internal threads 94 with the external threads 25 of the insulating rod 2. Numeral 85 is a lock nut for the main body of connecting rod 84.

The conventional insulation-operating rod for the porcelain-clad type circuit breaker is constructed as described above, in which the insulating rod 2 is threadably connected to the connecting rod 7 and 8. Accordingly, it is required that the connector 9 is designed to be considerably larger than the external diameter of the insulating rod 2. As a result, it is also required that the internal diameter of a pressure vessel accommodating the insulation-operating rod is larger. It is further required that length of the connector 9 along with the longitudinal axis is long enough to secure a required length of each thread, which influences connection strength between the insulating rod 2 and the connecting rods 7 and 8. Therefore, the conventional insulation-operating rod for the porcelain-clad circuit breaker has a problem in that not only weight influencing the operating characteristics is heavy but also cost of the parts is high.

Moreover, the conventional insulation-operating rod has following various problems. That is, manufacturing cost of the parts tends to be high because of need of applying threads to the insulating rod 2, connecting rods 7, 8 and connector 9. Adhesive coating on the threaded portions is also required to ensure coupling strength in such screw-thread coupling. There is a possibility of dispersion in mechanical strength as a result of uneven assembling. Man hour for assembling increases.

SUMMARY OF THE INVENTION

The present invention has been made to solve the above-discussed problems and has an object providing an insulation-operating rod having stable mechanical characteristics and electrical characteristics and capable of being compact as compared with the prior art.

According to one aspect of the invention, an insulation-operating rod includes a cylindrical insulating rod composed of an electrically insulating material, and a pair of connecting rods having a first shield portion for electric field relaxation on one end of each connecting rod. The first shield portion of the connecting rod and an end portion of the connecting rod continuous to the first shield portion are respectively inserted in an inserted end receiving portion of the insulating rod for receiving the inserted ends. Each connecting rod and the insulating rod are provided with a second shield portion for electric field relaxation on the external surface thereof, and are connected to each other through a metallic shield ring in which the inserted end receiving portion of said insulating rod is inserted and by a connecting pin passing through the metallic shield ring, the inserted end receiving portion and the end portion of the connecting rod.

As a result, since the insulating rod and the connecting rod are connected by the metallic shield rings and the connecting pins, any threading of the components is not necessary. Further, the insulating rod and connecting rod can be small-sized and light-weighted as compared with those used in the conventional insulation-operating rod. Furthermore, although any adhesive is applied to the thread in order to secure a mechanical strength of the thread-engaging portion in the prior art, any such application of adhesive is not required due to the connection with pin, making it possible to reduce man-hour for coating. As a result, it is now possible to achieve a light-weight, small-size, and cost-saving insulation-operating rod. Further, in the case of applying the insulation-operating rod according to the invention to a pressure vessel of a breaker, it becomes possible to make a pressure vessel light-weighted and small-sized as compared with the conventional one. Accordingly, it becomes possible to apply a smaller-sized operating system having smaller output than that of the prior art, which results in cost reduction of the breaker. Furthermore, the insulation-operating rod according to the invention is superior in electric characteristics, particularly in electrical insulation performance at portions to which direct current is applied.

It is preferable that the insulation-operating rod according to the invention is provided with a first gap and a second gap for preventing flashover respectively disposed between the end portion of the connecting rod and the inserted end receiving portion as well as between the metallic shield ring and the inserted end receiving portion; and further includes clearance change preventing means for preventing clearance change such as metallic spacer ring, metallic bushing or any other specific structure.

As a result, each clearance of the first gap and the second gap is maintained stable for a long time, thereby improving reliability in the electric characteristics of the insulation-operating rod.

In the insulation-operating rod according to the invention, it is preferable that the clearance change preventing means is a metallic spacer ring inserted between the metallic shield ring and the inserted end receiving portion as well as between the end portion of the connecting rod and the inserted end receiving portion.

In the insulation-operating rod according to the invention, it is also preferable that the clearance change preventing means is a metallic bushing in which the connecting pin is inserted, one end of the bushing coming in contact with the metallic shield ring, and another end of each bushing coming in contact with the end portion of the connecting rod.

In the insulation-operating rod according to the invention, it is also preferable that the clearance change preventing means has a construction in which at least a part of facing surface of the metallic shield ring and that of the inserted end receiving portion, and at least a part of opposed face of the end portion of the connecting rod and that of the inserted end receiving portion, are close to or in contact with each other within a range of not substantially producing any play clearance.

DESCRIPTION OF THE PREFERRED EMBODIMENTS

Embodiment 1

Figure 1:
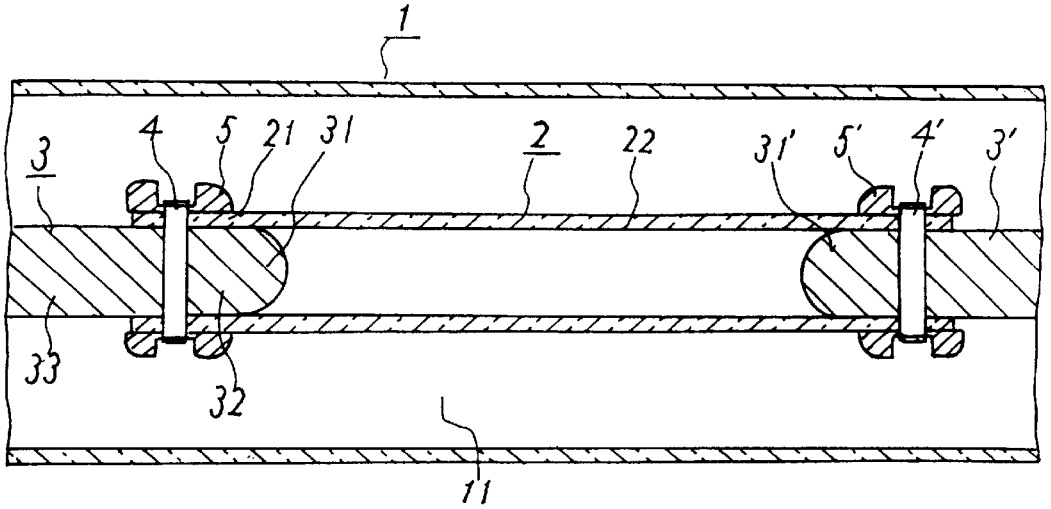
FIG. 1 is a sectional view of an insulation-operating rod according to Embodiment 1 of the present invention.
Figure 2:
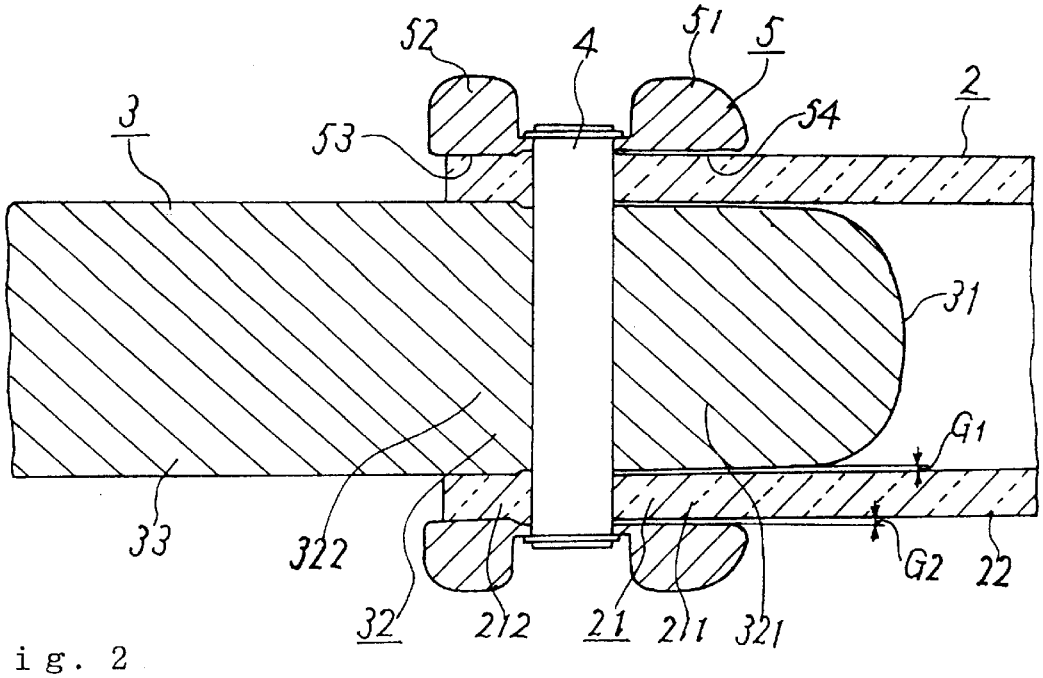
FIG. 2 is a partially enlarged sectional view of FIG. 1.

FIG. 1 is a sectional view of an insulation-operating rod according to Embodiment 1 of the present invention, and FIG. 2 is a partially enlarged sectional view of FIG. 1. In the drawings, reference numeral 1 is a pressure vessel composed of glass or the like, numeral 11 is an insulating gas composed of sulfur hexafluoride gas filling the cavity of the pressure vessel 1, and numeral 2 is a cylindrical insulating rod. Numerals 3 and 3' are a pair of connecting rods, numeral 4 and 4' are connecting pins, and numeral 5 and 5' are metallic shield rings. Either one of the connecting rods 3 and 3' (for example the connecting rod 3) is connected to a high voltage side, and another (for example the connecting rod 3') is grounded. As the structure of the two connecting rods are the same, construction and function are hereinafter described only about the connecting rod 3. The insulating rod 2 and the connecting rod 3 are connected by the connecting pin 4 and the metallic shield ring 5 as described later.

The insulating rod 2 is cylindrical, and is formed into a cylindrical shape, for example, by impregnating glass fibers with a thermosetting resin such as epoxy resin. The insulating rod 2 comprises a body portion 22 and an inserted end receiving portion 21 in which the connecting rod 3 is inserted. The inserted end receiving portion 21 comprises a portion 212 adjacent to opening and the remaining portion 211. The portion 212 adjacent to opening is small in thickness as compared with the remaining portion 211 by machining the external and inner surfaces thereof.

The connecting rod 3 comprises a first shield portion 31 for electric field relaxation on one end thereof, an end portion 32 continuous to the first shield portion 31 and a body portion 33 of the connecting rod. The first shield portion 31 and the end portion 32 of the connecting rod are inserted in the inserted end receiving portion 21 of the insulating rod 2. The end portion 32 of the connecting rod comprises an insert portion 322 received in the portion 212 adjacent to opening of the inserted end receiving portion 21 and a portion 321 continuous to the first shield portion 31. External diameter of the insert portion 322 is made to be the same size as internal diameter of the portion 212 adjacent to opening, while the external diameter of the portion 321 is made to be a size slightly smaller than the external diameter of the portion 322. In this manner, the connecting rod 3 is inserted in the inserted end receiving portion 21 of the insulating rod 2 without any substantial play clearance between the external surface of the portion 322 and the internal surface of the portion 212 adjacent to opening, but with a gap G1 between the external surface of the portion 321 and the internal surface of the portion 211.

The metallic shield ring 5 is provided with second shield portions 51 and 52 for electric field relaxation on the external surface thereof, a rod end portion 53 in which the portion 212 adjacent to opening is inserted without any substantial play clearance, and a gap forming portion 54 having an internal diameter slightly larger than the internal diameter of the rod end portion 53 and also slightly larger than the external diameter of the portion 211. In other words, the rod end portion 53 and the gap forming portion 54 of the metallic shield ring 5 are respectively disposed on the side of the portion 212 adjacent to opening and on the side of the portion 211 of the inserted end receiving portion 21, putting a portion for inserting the connecting pin 4 between those two sides. In this manner, a gap G2 is formed between the internal surface of the gap forming portion 54 and the external surface of the portion 211.

Eliminating any substantial play clearance between the external surface of the insert portion 322 and the internal surface of the portion 212 adjacent to opening, and inserting the insulating rod 2 in the rod end portion 53 without any substantial play clearance serve as means of preventing clearance change, whereby the clearance of gaps G1 and G2 are maintained stable.

As clearly shown in the drawing, the connecting pin 4 is inserted through the metallic shield ring 5, the inserted end receiving portion 21 of the insulating rod 2 and the end portion 32 of the connecting rod, whereby the insulating rod 2 and the connecting rod 3 are connected to each other by the connecting pin 4 and the metallic shield ring 5. In such a case, the metallic shield ring 5 prevents a play in radial direction of the insulating rod 2 particularly in the rod end portion 53 and also provides a function like a washer for the connecting pin 4, the connecting pin 4 acts to prevent a play in axial direction between the insulating rod 2 and the connecting rod 3. In addition, it is preferable that each of through holes for insertion of the connecting pin 4 and which are provided through the shield ring 5, the inserted end receiving portion 21 and the end portion of the connecting rod 32 is of highly accurate formed by reaming. It is also preferable that the connecting pin 4 is a reamer bolt.

Depending on the conditions of electric power system, a high potential of direct current may be applied to the insulating rod 2. In such a case, an electric field value of a high potential gradient exceeding the insulation performance may be generated particularly in the portion so-called a triple junction, where insulating gas, insulator and metal are adjacent to each other. Therefore, there is a possibility of occurring some trouble such as flashover caused by a creeping discharge along the internal surface of the insulating rod 2 between the connecting rods 3 and 3', dielectric breakdown through the side wall of the insulating rod 2, and so. To cope with such troubles, it is essential to control the clearance between the insulator and metal. Now, by employing the construction according to the invention in which the gaps G1 and G2 are provided, it becomes possible to prevent the mentioned trouble thereby maintaining a desired insulation performance.

Clearance volume of the gaps G1 and G2 is different depending on potential difference between the connecting rod 3 and the connecting rod 3' and on size of the insulation-operating rod according to the invention. For example, when the potential difference is about 100 kV to 500 kV and the diameter of the first shield portion 31 is about 50 mm to 150 mm, each clearance volume of the gaps G1 and G2 is about 0.5 to 5 mm.

Embodiment 2

Figure 3:
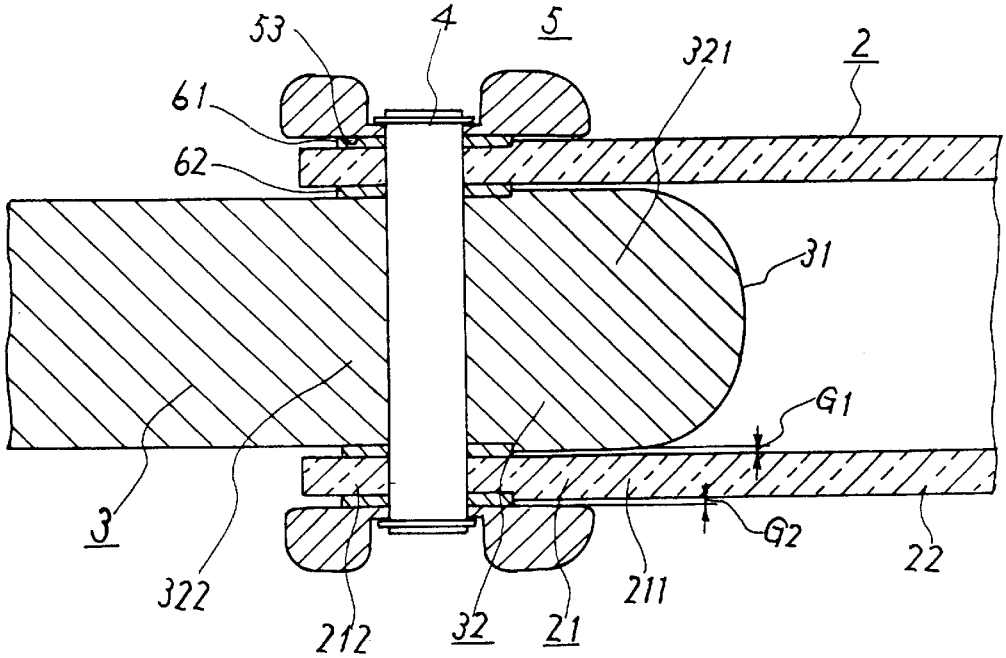
FIG. 3 is a sectional view of an insulation-operating rod according to Embodiment 2 of the invention.

In Embodiment 2 and later, like reference numerals are designated to like parts shown in the foregoing Embodiment 1 and the description thereof is omitted. FIG. 3 is a sectional view of an insulation-operating rod according to Embodiment 2 of the invention, and in which numerals 61 and 62 are metallic spacer rings for another example of the foregoing clearance change preventing means. In this Embodiment 2, inside and outside of a part of the wall extending from the portion 212 adjacent to opening to the portion 211 in the inserted end receiving portion 21 of the insulating rod 2 are subject to machining. Then, the metallic spacer rings 61 and 62 are disposed on the machined part and assembling is conducted in such a manner that the metallic spacer ring 61 comes in contact with the rod mounting portion 53 of the metallic shield ring 5 and the metallic spacer ring 62 comes in contact with the insert portion 322 of the connecting rod 3. In this process, the connecting rod 3 and the insulating rod 2 are connected to each other by means of the connecting pin 4 passing through the metallic shield ring 5, the metallic spacer ring 61, the inserted end receiving portion 21, the metallic spacer ring 62 and the end portion 32 of the connecting rod.

Embodiment 3

Figure 4:
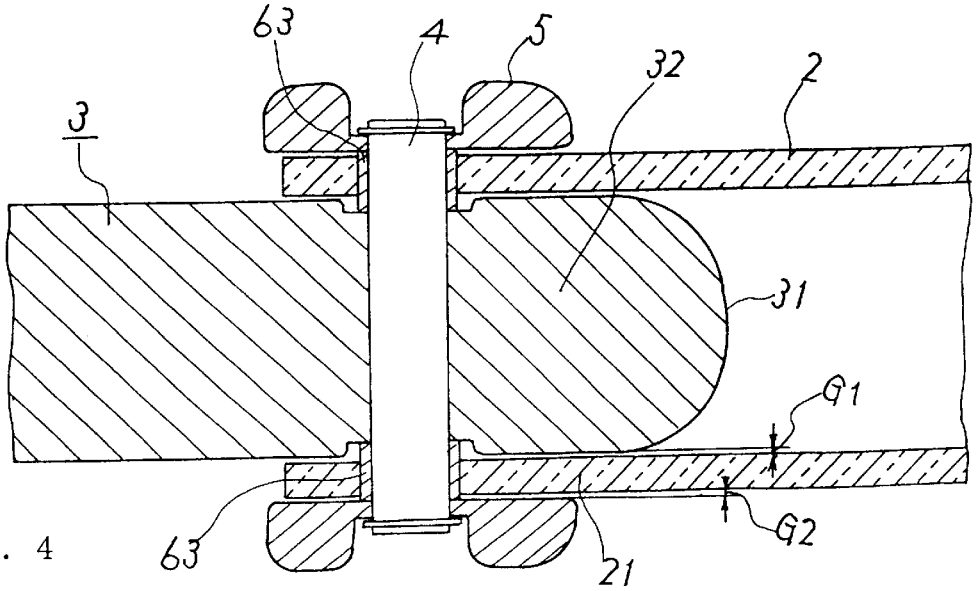
FIG. 4 is a sectional view of an insulation-operating rod according to Embodiment 3 of the invention.
Figure 5:
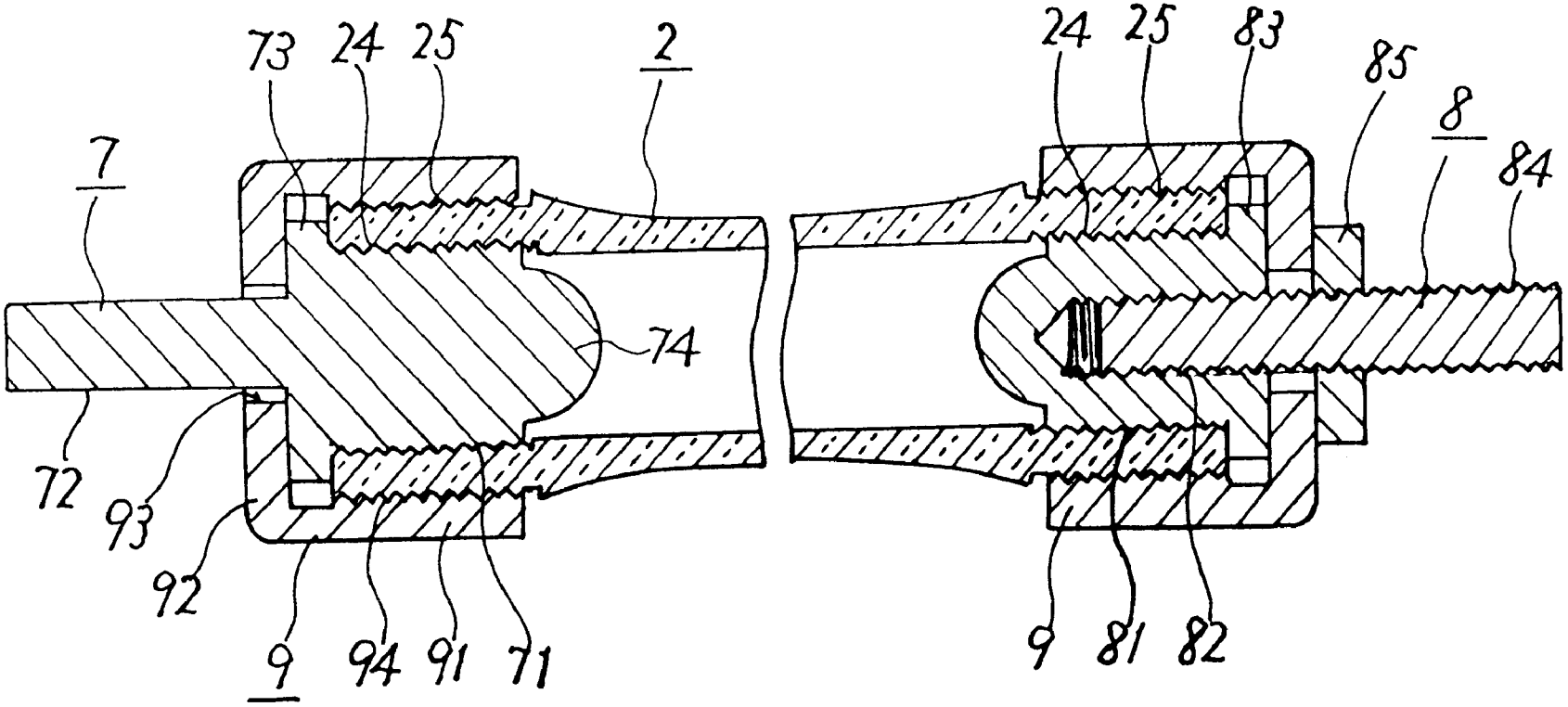
Fig. 5 (PRIOR ART)
FIG. 5 is a sectional view of one of the conventional insulation-operating rods.

FIG. 4 is a sectional view of an insulation-operating rod according to Embodiment 3 of the invention, and in which numeral 63 is a pair of metallic bushings as a further example of the means of preventing clearance change. The connecting pin 4 is inserted through the metallic bushings 63. The metallic bushings 63 are mounted in such a manner that one end of each metallic bushing 63 comes in contact with the metallic shield ring 5, while another end thereof comes in contact with the end portion 32 of the connecting rod.

What is claimed is:

1. An insulation-operating rod comprising:

a cylindrical insulating rod composed of an electrically insulating material; and a pair of connecting rods, each said connecting rod having a first shield portion for electric field relaxation on one end of said connecting rod, said first shield portion of each said connecting rod and an end portion of each said connecting rod continuous to said first shield portion being respectively inserted in an inserted end receiving portion of said insulating rod;

wherein each said connecting rod and said insulating rod are provided with a second shield portion for electric field relaxation on the external surface thereof, and wherein each said connecting rod and said insulating rod are connected together by (1) a metallic shield ring in which said inserted end receiving portion of said insulating rod is inserted, and (2) a connecting pin passing through said metallic shield ring, said inserted end receiving portion, and said end portion of said connecting rod.

2. The insulation-operating rod according to claim 1, wherein a first gap, for preventing flashover, is disposed between said end portion of said connecting rod and said inserted end receiving portion, wherein a second gap, for preventing flashover, is disposed between said metallic shield ring and said inserted end receiving portion, and wherein the insulation-operating rod further comprises clearance change preventing means for preventing a clearance change of said first and said second gaps.

3. The insulation-operating rod according to claim 2, wherein said clearance change preventing means is a first metallic spacer ring inserted between said metallic shield ring and said inserted end receiving portion, and a second metallic spacer ring inserted between said end portion of said connecting rod and said inserted end receiving portion.

4. The insulation-operating rod according to claim 2, wherein said clearance change preventing means is a metallic bushing in which said connecting pin is inserted, one end of said bushing contacting with said metallic shield ring, and another end of said bushing contacting with said end portion of said connecting rod.

5. The insulation-operating rod according to claim 2, wherein said clearance change preventing means has a construction in which (1) at least a part of facing surfaces of said metallic shield ring and said inserted end receiving portion, and (2) at least a part of facing surfaces of said end portion of said connecting rod and said inserted end receiving portion, are provided without any substantial play clearance.

* * * * *